US009683744B2

(12) United States Patent
Patel et al.

(10) Patent No.: US 9,683,744 B2
(45) Date of Patent: Jun. 20, 2017

(54) COMBUSTION SYSTEM FOR A GAS TURBINE ENGINE AND METHOD OF OPERATING SAME

(71) Applicant: Pratt & Whitney Canada Corp., Longueuil (CA)

(72) Inventors: Bhawan B. Patel, Mississauga (CA); Oleg Morenko, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 595 days.

(21) Appl. No.: 14/193,575

(22) Filed: Feb. 28, 2014

(65) Prior Publication Data

US 2015/0247641 A1 Sep. 3, 2015

(51) Int. Cl.

| | |
|---|---|
| ***F23R 3/28*** | (2006.01) |
| ***F23N 1/00*** | (2006.01) |
| ***F23C 6/04*** | (2006.01) |
| ***F23R 3/34*** | (2006.01) |

(52) U.S. Cl.

CPC ..... *F23R 3/28* (2013.01); *F23C 6/047* (2013.01); *F23N 1/002* (2013.01); *F23R 3/346* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,339,635 | A | 8/1994 | Iwai et al. | |
| 5,611,196 | A | 3/1997 | Wilson | |
| 5,687,571 | A | 11/1997 | Althaus et al. | |
| 5,829,967 | A | 11/1998 | Chyou et al. | |
| 5,983,642 | A | 11/1999 | Parker et al. | |
| 6,889,495 | B2 | 5/2005 | Hayashi et al. | |
| 7,343,745 | B2 | 3/2008 | Inoue et al. | |
| 8,387,398 | B2 * | 3/2013 | Martin | F01D 9/023 60/733 |
| 9,068,748 | B2 * | 6/2015 | Hoke | F23R 3/06 |
| 2011/0219779 | A1 | 9/2011 | Critchley et al. | |
| 2013/0327054 | A1 | 12/2013 | Patel et al. | |

OTHER PUBLICATIONS

European Search Report issued on Jun. 26, 2015 in corresponding EP application 15156518.1-1602.

* cited by examiner

*Primary Examiner* — David Walczak
(74) *Attorney, Agent, or Firm* — Norton Rose Fulbright Canada LLP

(57) ABSTRACT

A gas turbine engine comprises a combustion system comprising a secondary annular combustor and a primary combustor in fluid communication with the secondary combustor, a secondary fuel injector associated with the secondary combustor, a primary fuel injector associated with the primary combustor, and a ECU controlling fuel delivery to the secondary and primary fuel injectors. The primary fuel injector delivers fuel to the primary combustor. The ECU allows fuel to be delivered to the secondary fuel injector in addition to the primary fuel injector only when a fuel amount higher is requested delivered by the primary fuel injector. A method of operating a gas turbine engine is also presented.

17 Claims, 5 Drawing Sheets

COMBUSTION SYSTEM FOR A GAS TURBINE ENGINE AND METHOD OF OPERATING SAME

TECHNICAL FIELD

The application relates generally to gas turbine engines and, more particularly, to combustion systems for gas turbine engines.

BACKGROUND OF THE ART

Combustion systems of gas turbine engines provide power to the aircraft for various conditions during flight and on ground. Some conditions, such as idle or taxiing, require lower power from the combustion system, while other conditions, such as taking-off and altitude cruising require higher power from the combustion system. Fuel injectors, depending if they inject more or less fuel for high or low power, may produce unwanted by-products of combustion.

SUMMARY

In one aspect, there is provided a gas turbine engine comprising: a combustion system comprising: a secondary annular combustor and a primary annular combustor in fluid communication with the secondary combustor and converging thereto; a secondary fuel injector associated with the secondary annular combustor; a primary fuel injector associated with the primary annular combustor, the primary fuel injector delivering a maximum fuel amount to the primary annular combustor; a fuel conduit network fluidly connected to the secondary fuel injector and the primary fuel injector; and an electronic control unit (ECU) controlling fuel delivery to the secondary and primary fuel injectors via the fuel conduit network based on at least one input, the ECU allowing fuel to be delivered to the secondary fuel injector in assistance to the primary fuel injector only when the at least one input requires a fuel amount higher than a maximum fuel amount delivered by the primary fuel injector.

In another aspect, there is provided a method of actuating a combustion system for a gas turbine engine, the method comprising, in sequence: delivering fuel only to a primary fuel injector of a primary combustor of a combustion chamber including communicating secondary and primary combustors in response to a first input requiring a fuel amount lower than a maximum fuel amount delivered by the primary fuel injector; and delivering fuel to a secondary fuel injector of the secondary combustor in assistance to delivering fuel to the primary fuel injector of the primary combustor in response to a second input requiring a fuel amount higher than a maximum fuel amount delivered by the primary fuel injector.

DESCRIPTION OF THE DRAWINGS

Reference is now made to the accompanying figures in which.

DETAILED DESCRIPTION

Figure 1:
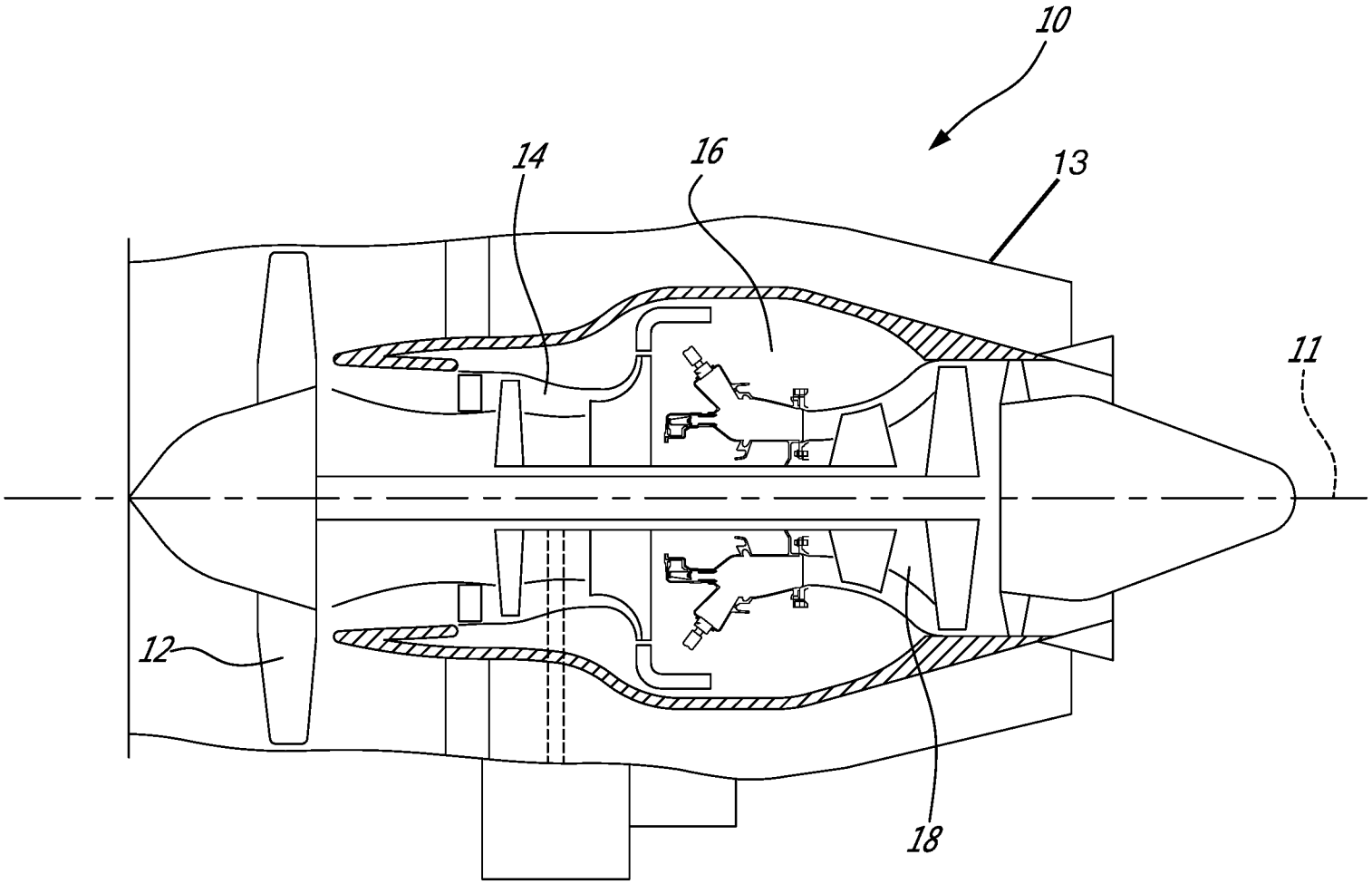
FIG. 1 is a schematic cross-sectional view of a gas turbine engine.

FIG. 1 illustrates a gas turbine engine 10 of a type preferably provided for use in subsonic flight, generally comprising in serial flow communication within a casing 13 a fan 12 through which ambient air is propelled, a compressor section 14 for pressurizing the air, a combustion system 16 in which the compressed air is mixed with fuel and ignited for generating an annular stream of hot combustion gases, and a turbine section 18 for extracting energy from the combustion gases. The gas turbine engine 10 has a longitudinal central axis 11.

Figure 2:
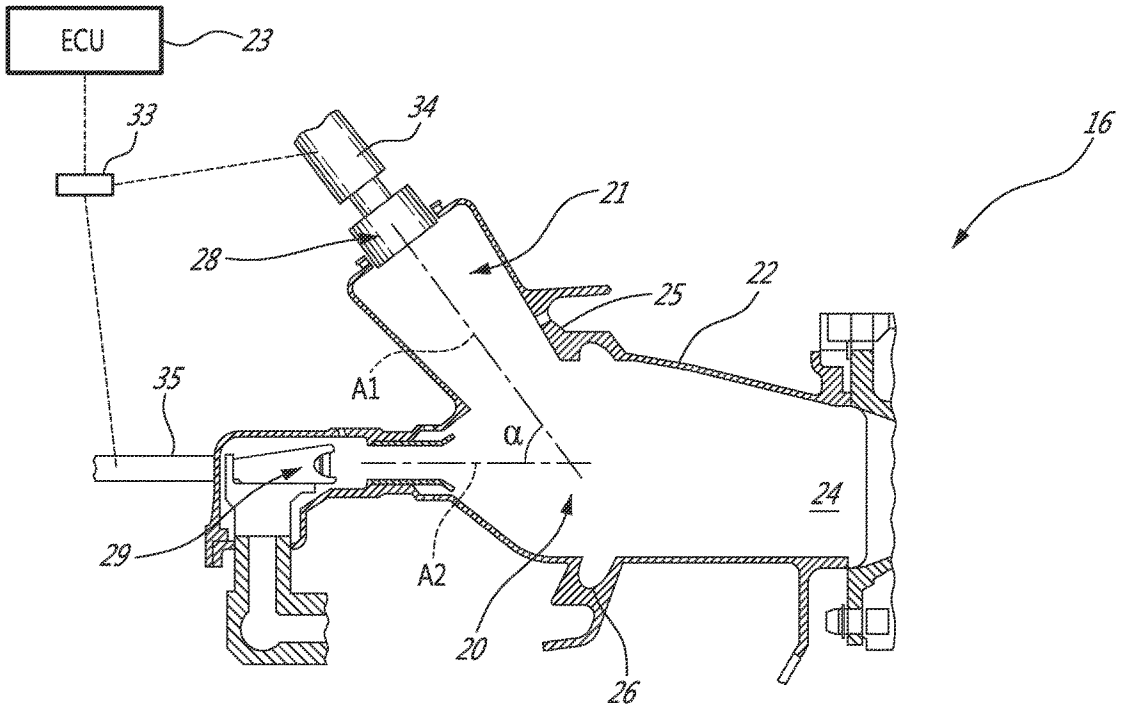
FIG. 2 is a schematic of a combustion system for a gas turbine engine such as the one of FIG. 1.

Turning now to FIG. 2, the combustion system 16 includes a combustion chamber 20 defining a primary combustor 21 and a secondary combustor 22 and an electronic control unit (ECU) 23 controlling the actuation of the combustors 21, 22.

The combustion chamber 20 comprises a main lobe for the secondary combustor 22 and a smaller lobe for the primary combustor 21. The combustion chamber 20 may be unitary or made of several parts joined to each other. The secondary 22 and primary combustors 21 are annular and converge to each other in this example. The secondary combustor 22 in this example is arranged generally parallel to an axis of the engine, while the primary combustor 21 is disposed radially outward of the secondary combustor 22. The primary combustor 21 in this example is disposed on along a primary combustor axis A1 which intersects with a secondary combustor axis A2 parallel to the engine axis 11 at an acute angle $\alpha$ of 25°. It is contemplated that the angle $\alpha$ could be comprised between 20° and 30° in another example.

The primary and secondary combustors 21, 22 are arranged in series. Although forming distinct combustion zones or chambers, the primary combustor 21 and the secondary combustor 22 are in fluid communication with each other. Exhaust gases from the primary combustor 21 reach the secondary combustor 22 before being evacuated via a single outlet 24 of the secondary combustor 22. A size of the primary combustor 21 may be determined to enable full combustion before the exhaust gases reach the secondary combustor 22.

The combustion chamber 20 includes a plurality of air inlets. A primary series of air inlets 25 is disposed on the primary combustor 21 and a secondary series of air inlets 26 is disposed on the secondary combustor 22. The air inlets 25, 26 allow external air to feed the combustion. Additional air is carried through porous walls of the combustion chamber 20.

An assembly of primary fuel injectors 28 is associated with the primary combustor 21, and a secondary fuel injector assembly 29, distinct from the primary fuel injector 28, is associated with the secondary combustor 22. The primary and secondary fuel injectors 28, 29 in use atomize fuel from a source delivered to them by associated primary and secondary fuel conduits 34, 35. The primary fuel injector 28 may be a series of discrete in-line or other suitable configuration fuel nozzles, while the secondary fuel injector assembly 29 may be an annular ring injector comprised of a much higher number of, typically smaller, fuel injection points such that effectively a continuous annular ring of fuel is injected into the secondary combustor, or other suitable configuration fuel nozzles. In one embodiment, the primary fuel injector 28 includes 6 to 9 injectors and the secondary fuel injector 29 includes between 60 and 70 injectors. It is contemplated that the primary fuel injectors 28 may also be ring injector, or may employ another suitable configuration. The secondary fuel injector 29, in one example, may be substantially as described in co-pending application Ser. Nos. 13/795,058, 13/795,082, 13/795,089 and 13/795,100, the entirety of each of which is hereby incorporated by reference.

Figure 3:
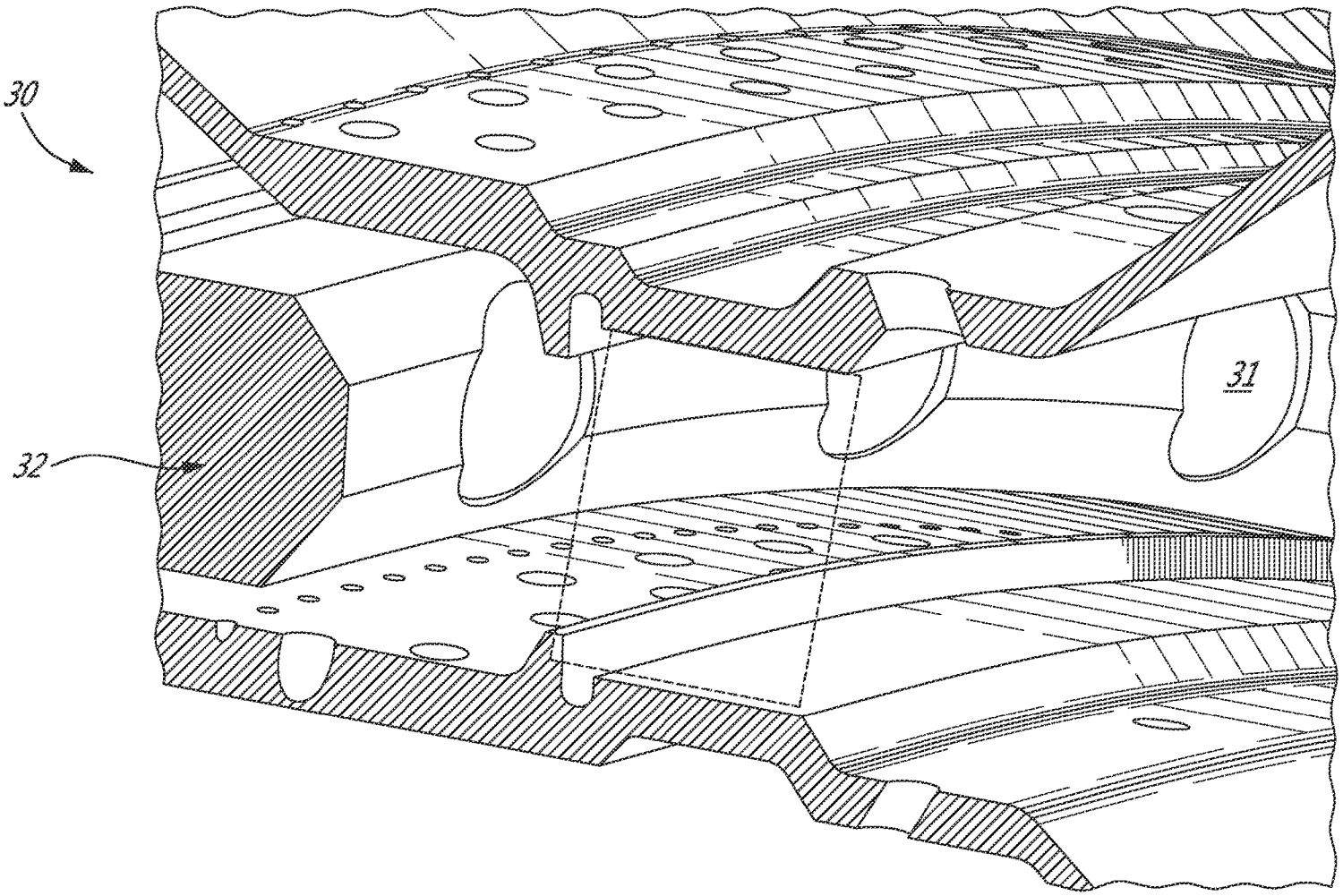
FIG. 3 is a cross-sectional view of an annular fuel nozzle for the combustion system of FIG. 2.

Referring to FIG. 3, an enlarged view of a portion of the secondary injector 29 is shown. A manifold 30 is schematically shown as having a plurality of closely-spaced fuel injector sites 31 facing downstream on an annular support 32. The annular support 32 may be in the form of a full ring, or a segmented ring. The fuel injector sites 31 are circumferentially distributed in the annular support 32, and each accommodate a fuel nozzle (not shown). Flat spray nozzles may be used to reduce the number of fuel injector sites 31 yet have a similar spray coverage angle. The number of nozzle air inlets may be substantially greater than the number of fuel injector sites 31, and thus of fuel nozzles of the manifold 30. A continuous circumferential distribution of the nozzle air inlets relative to the discrete fuel nozzles may be used to create a relatively uniform air flow throughout the upstream zone in which the fuel stream is injected in order to have a relatively uniform flow of atomized fuel into the secondary combustor 22.

Referring back to FIG. 2, the ECU 23 controls fuel delivered to the secondary and primary fuel injectors 28, 29. In one embodiment, the ECU 23 is in communication with a fuel flow divider valve 33 which controls which of the primary and secondary fuel injectors 28, 29 will receive fuel. The ECU 23 controls the divider valve 33 based on one or more inputs. The input may be associated with a command from the pilot, or the electronic pilot assistant, such as speed, altitude, and acceleration. The one or more inputs received by the ECU 23 may be associated with engine regimes. Engine regimes correspond to flight conditions such as idle, taxiing or take-off and can be divided into at least two classes, namely lower power engine regimes and higher power engine regimes. Inputs may also include commands linked with turning on and off the combustion in the combustion chamber 20. An amount of fuel delivered to each of the fuel injectors 28, 29 may also be varied by the divider valve 33 upon control by the ECU 23. More or less power (and therefore fuel) is required from the combustion chamber 20 depending on the engine regime. This modulation of power is achieved by selectively actuating the secondary combustor 22 to assist the primary combustor 21 which has a limited combustion power. The primary combustor 21 is actuated alone for the lower power engine regimes, while the secondary combustor 22 is actuated only for the higher power engine regimes and is actuated in addition to the primary combustor 21. Take-off and altitude cruising are examples of engine regimes requiring more power from the combustion chamber 20 (and thus more fuel) than the primary combustor 21 alone could provide, and for which the secondary combustor 22 will be actuated. A method of actuating the combustion system 16 will be described below.

Figure 4:
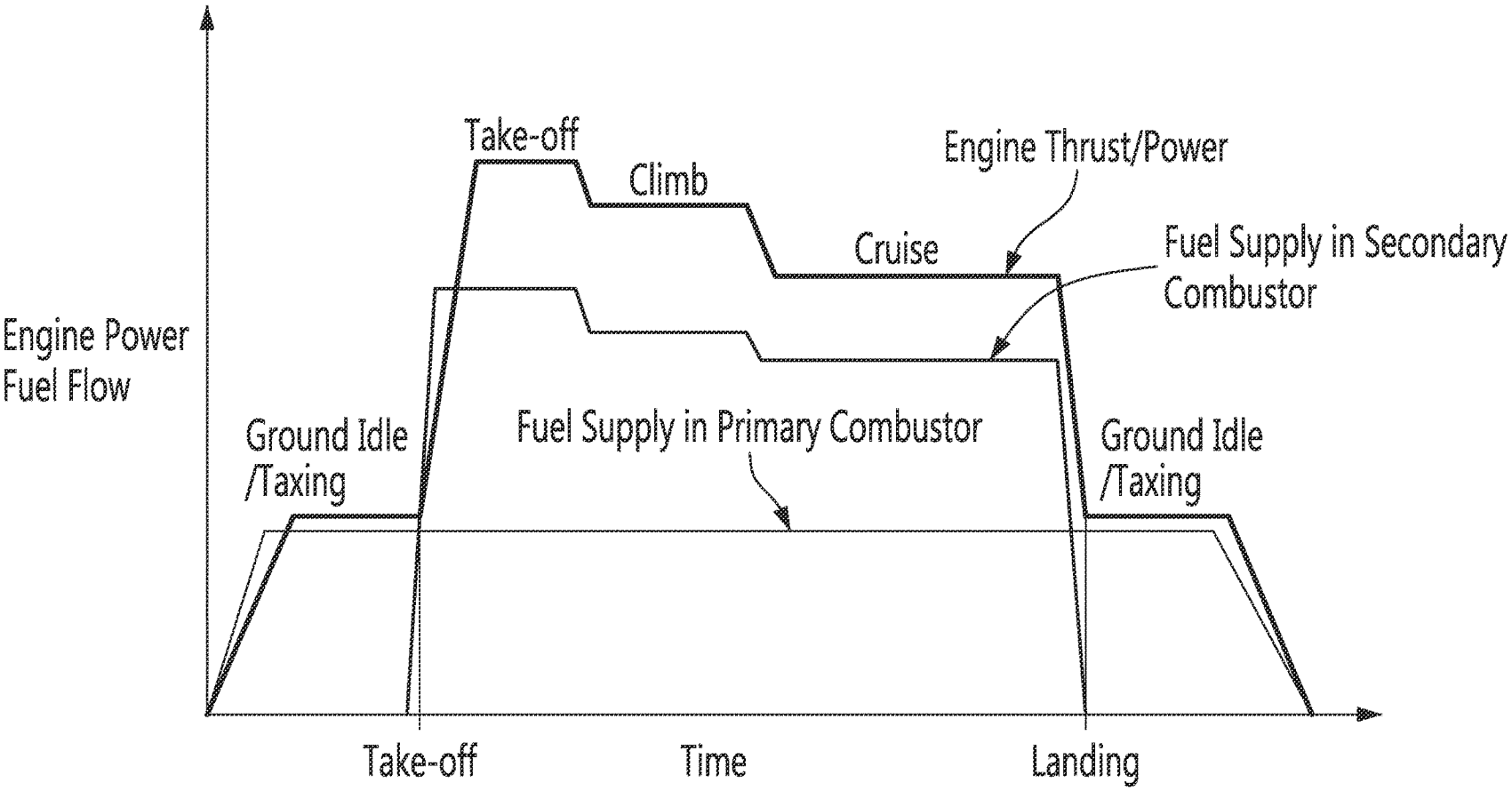
FIG. 4 is a graph showing a typical aircraft engine mission cycle.

Having two combustors 21, 22 associated with two distinct fuel injectors 28, 29 may allow operating each combustor 21, 22 at an overall enhanced combustion efficiency which may allow reducing unwanted gas by-products. Referring to FIG. 4, which shows a typical aircraft engine mission cycle, one combustor, such as the secondary combustor 22 in this example, may be optimized to provide an enhanced combustion efficiency at higher power, such as take-off or altitude cruising, while the other combustor (the primary combustor 21 in this example) is optimized to provide an enhanced combustion at efficiency lower power, such as ground idle or taxiing. FIG. 4 shows an engine thrust/power, fuel supply for combustion in the secondary combustor 22, and fuel supply for combustion in the primary combustor 21 in function of time, along with different engine regimes. Combustion efficiency depends on several parameters such as one or more of given fuel flow, air flow, fuel pressure air flow, maximum temperature, number of fuel nozzles, or combustor volume. Other parameters are contemplated. Combustors and injectors that are operated in engine regimes they are not optimised for may produce environmentally hazardous by-products. For example, the secondary combustor 22 and injector 29 which may not be designed for enhanced combustion at lower power engine regimes may produce excess mounts hydrocarbon when used in those regimes. In another example, the primary combustor 21 and injector 28 which may not be designed for enhanced combustion higher power engine regimes may produce nitride oxide when used in those regimes. While reducing consumption of fuel may reduce the production of nitride oxide and other environmentally hazardous gases, a flame of the injector 29 may become unstable. By having two distinct fuel injectors 28, 29, stability of the flame is also addressed since the primary fuel injector 28 may act as a back-up flame. Traditionally, it has been difficult to optimize for all flight phases with one combustion chamber.

To achieve enhanced combustion efficiency overall, a contribution of each of the combustors 21, 22 to a total power delivered by the combustion chamber 20 may be optimized. For example, as shown in the example of FIG. 4, at lower power, the combustion chamber 20 is operated by utilizing the primary combustor 21 only, and when higher power is needed, the combustion chamber 20 is operated such that the primary and secondary combustors 21, 22 are utilized. In one example, in high power mode at least 50% of the fuel delivered to the combustion chamber 20 is delivered to the secondary fuel injector 29 and less than 50% of the fuel delivered to the combustion chamber 20 is delivered to the primary fuel injector 28. There are thus at least two operating modes of the combustion system 16: a first mode where only the primary combustor 21 is used in low power operation, and a second mode where the primary and secondary combustor 21, 22 are used in high power operation. In view of the above example, the primary fuel injector 28 would be configured to deliver an appropriate fuel amount and scheduling to the primary combustor 21, while the secondary fuel injector 29 would be configured to deliver an appropriate fuel amount and scheduling to the secondary combustor 22. In another embodiment, in a high power mode the primary fuel injector 28 delivers about 18 to 25% of the total fuel amount provided to the combustion chamber 20, while the secondary fuel injector 29 delivers a remainder (e.g. 75 to 82%) of the fuel to the combustion chamber 20. In a particular embodiment, the amount of fuel delivered to the secondary combustor is about 80% of a total fuel flow provided to the primary and secondary combustors. In a particular embodiment, in a high power mode, the fuel amount delivered to the primary combustor is 20% of the total fuel amount delivered to the primary and secondary combustion chambers. In another example, in a high power mode, the primary combustor 21 delivers about 18 to 25% of the total thermal power, while the secondary combustor 22 provides the remainder.

Figure 5:
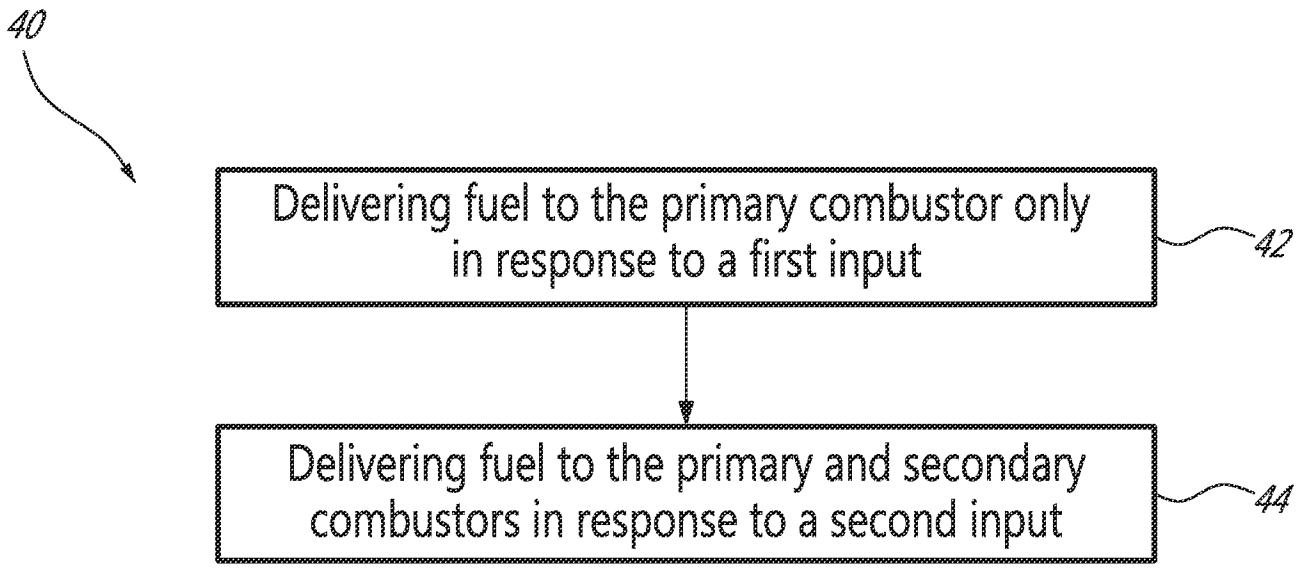
FIG. 5 is a flow chart of a method of actuating the combustion system of FIG. 2.

Turning now to FIG. 5, a method 40 of actuating the combustion system 16 will be described.

The method starts at step 42 with the actuation of only the primary combustor 21. Actuation may be based on a first input power request, and may correspond to a command from the cockpit or control system commanding a start to the combustion system 16 or to low power setting, such as ground idle or taxiing in the example described above. Because the input requires a fuel amount lower than a threshold between a lower and a higher power regimes (as discussed in the example above), step 42 is performed by the primary combustor 21 alone. The primary combustor 21 would be actuated alone as long as a the power required by the input is lower than a defined threshold defined between the low and high power modes. The primary combustor 21 is thus actuated, for example by the ECU 23 instructing the divider valve 33 to direct fuel to the primary fuel injector assembly 28 only. Step 42 therefore corresponds to lower power engine regimes, where only the primary combustor 21 is actuated in this example. In one embodiment, the primary combustor 21 is configured to provide an enhanced combustion at the lower power engine regimes, and as such may emit reduced hydrocarbons or other unwanted by-products compared to traditional (single regime) combustors.

From step 42, the method goes to step 44, where in response to a second input power request above a threshold between low and high power regimes, such as a command from the cockpit or control system turning commanding high power operation such as takeoff power, the primary combustor 21 and secondary combustor 22 are actuated. The threshold corresponds to a predetermined fuel amount above which the secondary combustor 22 is to be actuated. In one embodiment, the threshold corresponds to a required fuel amount is higher than the maximum fuel amount which can be delivered by the primary fuel injector assembly 28. Based on the power requested, the ECU 23 may position the divider valve 33 to direct fuel to the secondary fuel injector assembly 29 in addition to the primary fuel injector assembly 28. The amount of fuel delivered to the fuel injectors 28, 29 may be varied by the divider valve 33 controlled by the ECU 23, and may depend on an amount of power required. For example, as higher powers are required, a higher fuel amount may be delivered to the secondary combustor 22. According to the example described above, a majority of the overall fuel supplied to the combustor 20 at step 44 is provided to the secondary combustor 22, the secondary combustor 22 may be configured by design to be optimized for more efficient combustion the higher power engine regimes, which may result in reduced nitride oxides or other by-products produced compared to traditional (single regime) combustors The dual stage combustion chamber and method described herein allows selectively using different combustion chambers in cooperation to provide complementary power in a selected engine regime. In addition, the combustors may be optimized to operate more efficiently at the selected regimes for which they are configured to operate, and may thus provide an overall enhanced efficiency, and/or reducing unwanted by-products. In addition, having multiple combustion chambers operated in cooperation allows having two flames which may act as a back-up form each other in case one flames out. Because one (in this case, the secondary) combustor may be configured for higher power engine regimes, it may be configured as a lean combustor with a low air ratio.

The above description is meant to be exemplary only, and one skilled in the art will recognize that changes may be made to the embodiments described without departing from the scope of the invention disclosed. For example, the primary combustion chamber can be any suitable configuration. Although an annular primary chamber is described above, primary combustion may instead occur in a plurality of can combustors each with its fuel nozzle and igniter and in communication with the secondary chamber otherwise as described. The combustion chamber could include more than two combustion stages if desired, and any suitable number of combustion stages may be provided. The threshold between low and high power may be determined in any suitable fashion, and the split between fuel supply to combustion stages may be any suitable. Any suitable method of controlling fuel flow to the nozzle systems may be employed. Still other modifications which fall within the scope of the present invention will be apparent to those skilled in the art, in light of a review of this disclosure, and such modifications are intended to fall within the appended claims.

The invention claimed is:

1. A gas turbine engine comprising:

a combustion system having a primary combustor in fluid communication with a secondary combustor downstream thereof relative to a flow of fuel circulating therein, the primary combustor disposed radially outward of the secondary combustor;

a primary fuel injector assembly associated with the primary combustor;

a secondary fuel injector assembly associated with the secondary combustor;

a fuel conduit network fluidly connected to the primary and secondary fuel injector assemblies; and an electronic control unit (ECU) configured in a first mode for delivering fuel from a source via the conduit network only to the primary fuel injector assembly and in a second mode from a source via the conduit network to both the primary and secondary fuel injector assemblies.

2. The gas turbine engine as defined in claim 1, wherein the secondary fuel injector assembly comprises a plurality of fuel injection points to deliver a substantially uniform annular flow of fuel to the secondary combustor.

3. The gas turbine engine as defined in claim 1, wherein the primary combustor is an annular combustor.

4. The gas turbine engine as defined in claim 1, wherein the primary combustor converges downstream as it communicates with the secondary combustor.

5. The gas turbine engine as defined in claim 1, wherein the primary combustor and the secondary combustor converge at an angle comprised between 20° and 30°.

6. The gas turbine engine as defined in claim 1, wherein the primary and secondary combustors are arranged in series, the primary emptying into the secondary, and a combined combustion chamber therefore has a single outlet.

7. The gas turbine engine as defined in claim 1, wherein the secondary combustor is arranged generally parallel to a central axis of the gas turbine engine, and the primary combustor is disposed along a primary combustor axis which intersects with the central axis of the gas turbine engine.

8. A method of operating a gas turbine engine, the engine having a primary combustor fed by a primary fuel injector assembly and a secondary combustor serially downstream of the primary combustor and fed by a secondary fuel injector assembly, the method comprising, in sequence:

a) in response to a low power command input which is below a selected power threshold level, delivering fuel only to the primary fuel injector assembly of the primary combustor; and b) in response to a high power command input which is above said selected power threshold level, delivering fuel serially downstream of the primary combustor to the secondary fuel injector assembly of the secondary combustor while also delivering fuel to the primary fuel injector assembly of the primary combustor.

9. The method as defined in claim 8, wherein more fuel is delivered to the secondary fuel injector assembly than the primary fuel injector assembly in step b).

10. The method as defined in claim 8, where the fuel delivered to the secondary combustor in step b) is between 75% and 82% of total fuel flow provided to the primary and secondary combustors.

11. The method as defined in claim 8, wherein fuel delivered to the secondary combustor is about 80% of a total fuel flow provided to the primary and secondary combustors.

12. The method as defined in claim 8, wherein delivering fuel only to the primary fuel injector in response to the low power command input comprises delivering fuel only to the primary fuel injector in response to the low power command input requiring a fuel amount lower than a maximum fuel amount delivered by the primary fuel injector.

13. The method as defined in claim 8, wherein a fuel flow amount delivered to the primary combustor in step b) is between 18% and 25% of a total fuel flow amount delivered to the primary and secondary combustion chambers.

14. The method as defined in claim 8, wherein the fuel amount delivered to the primary combustor in step b) is 20% of the total fuel amount delivered to the primary and secondary combustion chambers.

15. The method as defined in claim 8, wherein a fuel flow rate provided to the primary combustor is about 50% of a total fuel flow rate delivered to the primary and secondary combustion chambers in steps a) and b).

16. The method as defined in claim 8, wherein step b) corresponds to at least one of a take-off and an altitude cruising flight condition.

17. The method as defined in claim 8, wherein step a) corresponds to at least one of start of a combustion system, taxiing and idle operating conditions.

* * * * *